United States Patent [19]

Harris

[11] 4,366,941

[45] Jan. 4, 1983

[54] ICE CUBE TRAY

[76] Inventor: Carl H. Harris, P.O. Box 245, Pavo, Ga. 31778

[21] Appl. No.: 322,940

[22] Filed: Nov. 19, 1981

[51] Int. Cl.[3] ..... F25C 1/22; B29C 1/00

[52] U.S. Cl. ..... 249/120; 249/121; 249/126; 249/129; 249/119

[58] Field of Search ..... 249/119, 120, 121, 126, 249/129

[56] References Cited

U.S. PATENT DOCUMENTS

| | | | |
|---|---|---|---|
| 2,469,067 | 5/1949 | Follin | 249/120 |
| 2,961,850 | 1/1960 | Tupper | 249/119 X |
| 3,776,504 | 12/1973 | Wiley | 249/121 |
| 4,147,324 | 4/1979 | Walter | 249/126 X |
| 4,162,780 | 7/1979 | Rankin | 249/126 X |

*Primary Examiner*—J. Howard Flint, Jr.

*Attorney, Agent, or Firm*—B. P. Fishburne, Jr.

[57] ABSTRACT

Metal or plastic ice cube trays have flat lids hinged along one edge to facilitate emptying ice cubes in an orderly manner when the tray is inverted and held under running water. The trays are stackable and have support legs of sufficient length to hold the ice cube compartments of each tray spaced from the lid of the next underlying tray to avoid a freezing bond between trays. The tray lids have corner notches which receive and help to position said legs when the trays are stacked.

2 Claims, 3 Drawing Figures

ICE CUBE TRAY

BACKGROUND OF THE INVENTION

Existing ice cube trays, whether metal or plastic, have certain common drawbacks. Since the trays are without lids, when they are inverted and held under running water, the ice cubes generally fall out into the sink and are partly melted before they can be recovered. There is no way to dump the cubes from the tray in an orderly manner. It is the prime object of this invention to eliminate this drawback of the prior art.

Other deficiencies of existing trays is that they are not readily stackable without external lateral support and no means is provided to prevent stacked trays becoming frozen together and very difficult to separate. The present invention also has for its objective to completely eliminate these drawbacks.

Other objects and advantages of the invention will become apparent during the course of the following a detailed description.

DETAILED DESCRIPTION

Figure 1:
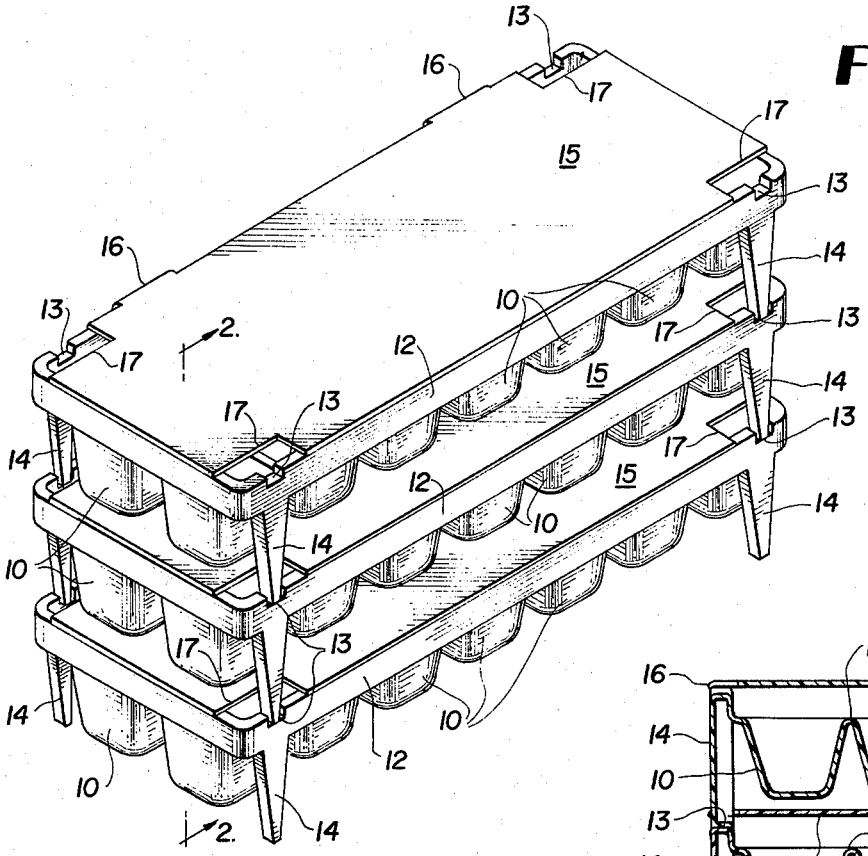
FIG. 1 is a perspective view of stacked ice cube trays constructed in accordance with the invention.

In the drawings, a plastic ice cube tray has been illustrated, and it should be understood that the invention can be embodied in a metal tray.

Referring to the drawings in detail, each tray includes an elongated body portion having two rows of side-by-side depressed ice cube compartments 10, these compartments being equidistantly spaced apart in the rows and integrally joined at their tops in the rows to adjacent compartments 10 and similarly joined to the compartments 10 of the parallel row as by an integral bight portion 11. Each tray body portion at its top also includes a marginal flange 12 giving strength to the tray and these flanges have stacking leg locator notches 13 formed therein near the four corners of the tray.

Each tray near its corners has four depending vertical support legs 14 rigid therewith, the lower tips of which engage in the locator notches 13 of underlying trays when the trays are stacked, FIG. 1.

Figure 2:
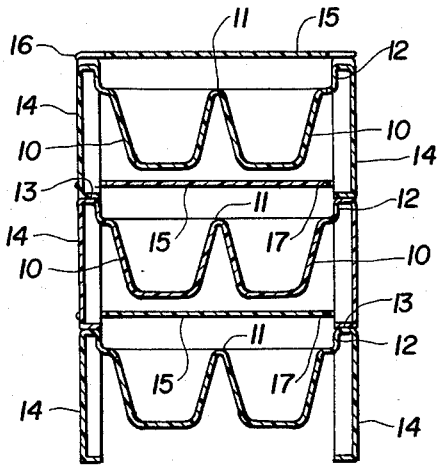
FIG. 2 in a transverse vertical section taken on line 2—2 of FIG. 1.

In accordance with the main feature of the invention, each ice cube tray is provided at its top with a flat lid 15 hinged to one longitudinal edge of the tray as by hinges 16 which may be integral with the lid and tray body in the case of a plastic product. Each lid at its corners has leg clearance notches 17 and the longitudinal edges of these notches, FIG. 2, serve to align and prevent lateral mislocation of the stacking legs 14 with the locator notches 13.

A feature of the invention resides in having the legs 14 sufficiently long that when the trays are stacked the bottoms of the cube compartments 10 are always spaced from the closed lids 15 to prevent the stacked trays from freezing together solidly, which is very inconvenient.

Figure 3:
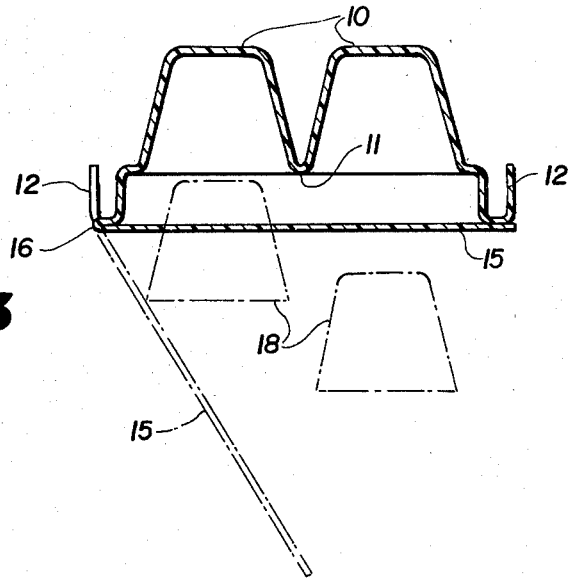
FIG. 3 is a cross section taken through an inverted ice cube tray as the cubes are being dispensed.

FIG. 3 illustrates the operation of the main feature whereby the hinged lid controls the discharging of ice cubes 18 when a tray is inverted and held under running water over a sink. Customarily, when the freeze bond is melted, the ice cubes will drop into the sink in an inconvenient disorderly manner and will be partly melted by the water before they can be recovered. To avoid this, the lid 15 is simply held closed until the freeze bond is loosened and the lid is allowed to open only when the tray is held over a chosen cube storage container.

It may be seen that the ice cube tray according to the invention fully eliminates several inconveniences and inadequacies of the prior art without adding greatly to the cost of the tray when greatly increasing its usefulness and convenience. The elements added to the tray do not significantly increase its bulk or size.

It is understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An ice cube tray adapted for stacking with identical trays in a manner preventing freeze bonding of the stacked trays, comprising a tray body portion including plural ice cube compartments of a common depth, said body portion having an upper marginal flange defining the perimeter of the tray and the flange being provided near the four corners of the tray with stacking leg locator notches, depending corner stacking legs on the tray projecting below the bottoms of the ice cube compartments and adapted when trays are stacked to engage in said locator notches of underlying trays, and a lid for the tray hinged thereto at one side of the tray and substantially covering the tops of all said compartments when the lid is closed against the top of said marginal flange, the lid having four corner stacking leg clearance notches and the longitudinal edges of such notches guiding said legs when trays are stacked and preventing lateral displacement of the legs from the locator notches, the lid when closed serving to retain ice cubes in an inverted tray until it is desired to open the lid and release the cubes over a storage receptacle, and said legs maintaining the bottoms of cube compartments in stacked trays spaced from the tops of closed lids of other trays to prevent the freezing together of stacked trays.

2. An ice cube tray as defined in claim 1 molded as a unit from plastics material and said lid being integrally hinged to said marginal flange at one longitudinal edge thereof.

* * * * *